United States Patent [19]

Rosenberg

[11] 4,098,440

[45] Jul. 4, 1978

[54] COLLAR POINT FORMER

[75] Inventor: George J. Rosenberg, St. Paul, Minn.

[73] Assignee: Fashion Services, Inc., Minneapolis, Minn.

[21] Appl. No.: 779,332

[22] Filed: Mar. 21, 1977

[51] Int. Cl.[2] ..... A41H 43/00

[52] U.S. Cl. ..... 223/39

[58] Field of Search ..... 223/39–43

[56] References Cited

U.S. PATENT DOCUMENTS

| | | | |
|---|---|---|---|
| 1,273,807 | 7/1918 | Barnett | 223/41 |
| 1,421,104 | 6/1922 | Sidwell | 223/41 |
| 1,439,844 | 12/1922 | Scully | 223/41 |
| 1,835,826 | 12/1931 | Vaccarella | 223/41 |

FOREIGN PATENT DOCUMENTS

| | | | |
|---|---|---|---|
| 514,583 | 12/1930 | Fed. Rep. of Germany | 223/41 |

*Primary Examiner*—Doris L. Troutman

*Attorney, Agent, or Firm*—Merchant, Gould, Smith, Edell, Welter & Schmidt

[57] ABSTRACT

A device for turning tubes and collar points is disclosed in which two symmetric members are pivotally attached in scissors, or tong-like fashion. The members terminate at opposed, abutting end portions, which are separable by a scissors movement of the members. One of the end portions is tapered to a relatively fine point, whereas the other end portion terminates in a rounded, blunt, relatively large tip.

4 Claims, 4 Drawing Figures

FIG. 1
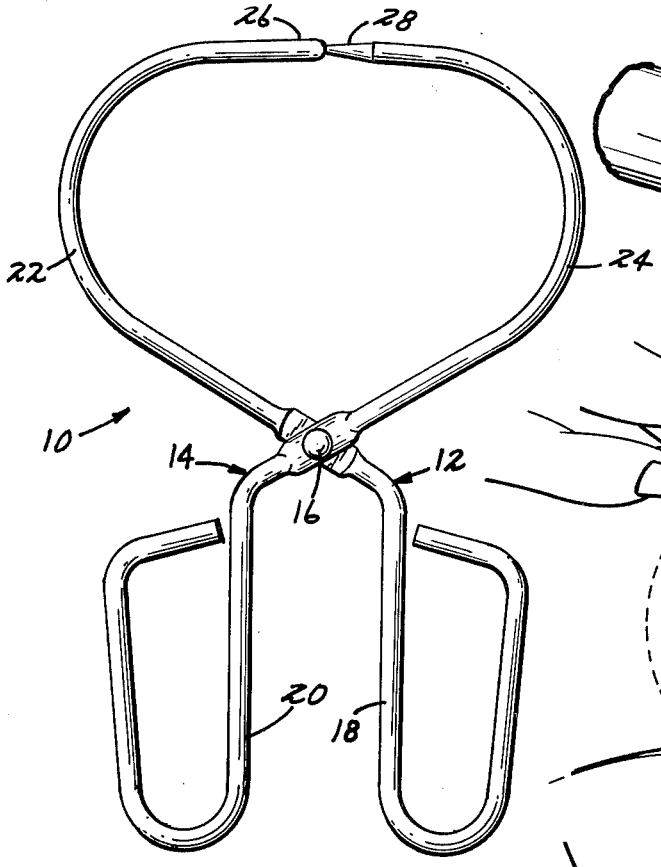
FIG. 2
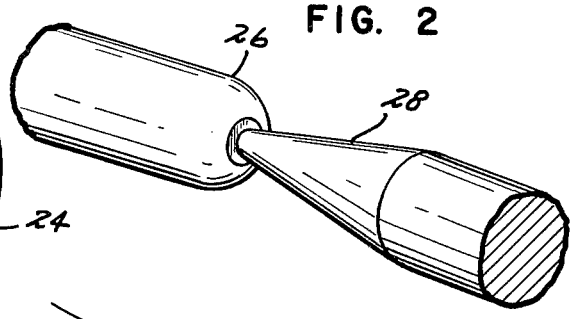
FIG. 3
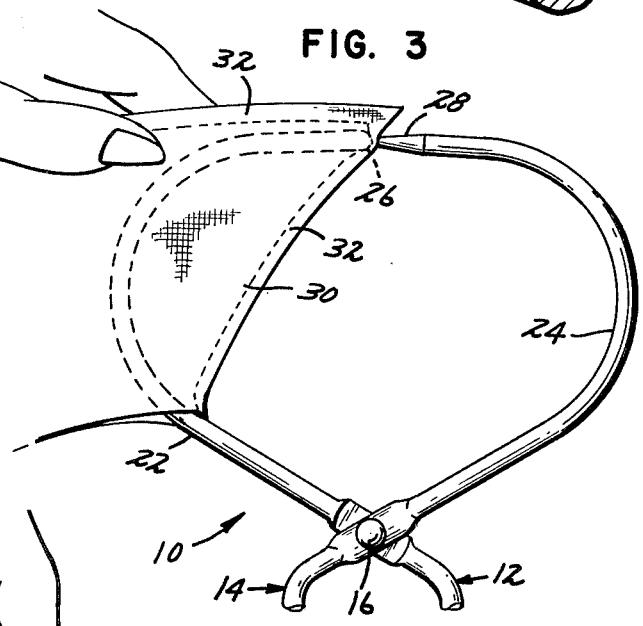
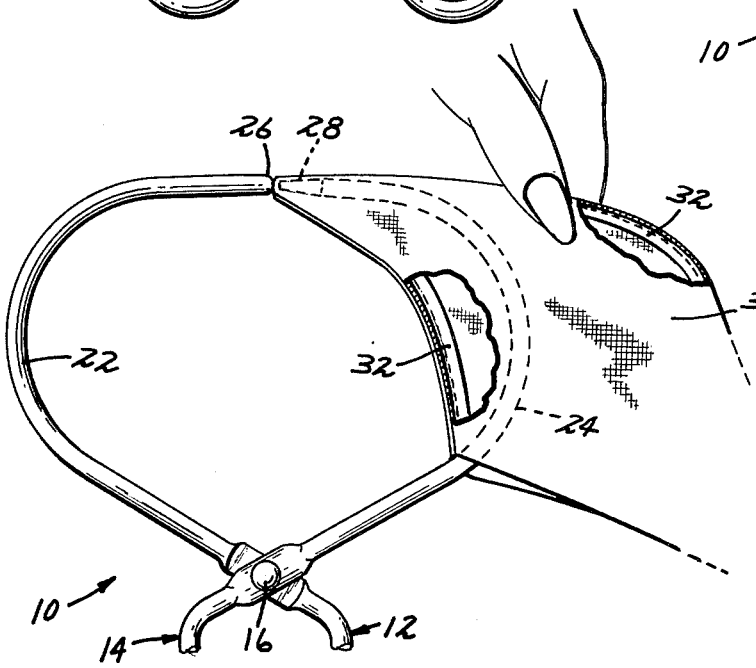
FIG. 4

COLLAR POINT FORMER

BACKGROUND OF THE INVENTION

1. Field of the Invention

This invention relates generally to the field of sewing accessories, and more particularly concerns devices for turning stitched collar points and tubes right side out.

2. Description of the Prior Art

When sewing certain articles, such as collars, spaghetti straps, and other tubes, the stitching operation must be performed on a side of the garment which will not be seen in the finished product. Traditionally, collars and tubes have been stitched inside out, and then turned right side out to finish the garment.

This turning operation can be performed with any appropriate, elongated, slender object, such as a pencil, or knitting needle. The most successful device for performing this operation developed to date is a scissors, or tong-like device. The device is comprised of two symmetric arms pivotally attached to one another. The portion of the arms above the pivot point define a closed oval, which may be broken by separating the abutting ends of each arm by a scissors-like motion of the arms. In the previously known point and tube turner of this type, each arm has terminated in a relatively fine, tapered tip; the tips of each arm being symmetric. As a result of this tip construction, the opposed tips may become misaligned upon closing of the tongs. The resulting misalignment severely impairs, if not destroys, the ability of the tongs to perform the turning function.

SUMMARY OF THE INVENTION

In accordance with the present invention, an improved point and tube turning device is constructed of a pair of symmetric arms pivotally mounted in scissors fashion to one another, wherein the abutting tips of each arm are not symmetric in design. One of the arms terminates in a tapered, relatively fine tip, whereas the opposed tip of the other arm is rounded, blunt, and relatively large in comparison to the first tip. As a result of this design, the opposed tips always meet upon closing of the arms, and cannot become misaligned under normal working conditions.

BRIEF DESCRIPTION OF THE DRAWINGS

FIG. 1 is a view in side elevation showing the point and tube turning device of the present invention.

FIG. 2 is an enlarged perspective view of a portion of FIG. 1, showing the abutting, opposed tip portion of the arms of the point and tube turning device.

FIG. 3 is a view of a portion of FIG. 1, illustrating the first step in the turning of a collar point.

FIG. 4 is a view similar to FIG. 3, illustrating a final step in the turning of the collar point.

DETAILED DESCRIPTION OF THE PREFERRED EMBODIMENT

Referring first to FIG. 1, there is shown a point and tube turning device 10 constructed in accordance with the present invention. Point and tube turner 10 comprises a first arm 12 and a second arm 14. Arms 12 and 14 are pivotally mounted to each other at pivot point 16.

As is shown, arms 14 and 12 are symmetric, each comprising a lower, handle portion 18 and 20, respectively, and an upper head portion, 22 and 24, respectively. Head portions 22 and 24 terminate in opposed, abutting tip portions 26 and 28, which are more clearly shown in FIG. 2. Arms 12 and 14 are adapted to move in scissors fashion around pivot point 16, thereby effecting an opening and closing of tips 26 and 28. In the preferred embodiment, head portions 22 and 24 define an oval shaped curve having no sharp bends or angles, so that a piece of cloth may slide smoothly over either head portion. Head portions 22 and 24 also have uniform circular cross sections over their lengths, excluding tip portions 26 and 28.

As can be seen in FIG. 2, tip portion 28 is tapered to a relatively fine point: the point is fine enough so that it may effectively turn collar points, as shown in FIG. 4, but not so fine as to pierce the fabric being turned. As is also shown in FIG. 2, tip portion 26 is rounded, blunt, and relatively large in comparison to tip portion 28, so as to provide a large surface upon which fine tip 28 may abut when the tips are closed by a scissors action of arms 14 and 12.

In operation, tips 28 and 26 are opened to allow a stitched collar to be placed over blunt tip 26 as is shown in FIG. 3. It is understood, of course, that collar 30 could also be a spaghetti strap, or a tube. After collar 30 has been placed on head portion 22 of arm 12, tips 28 and 26 are brought into abutting relationship, with the collar point held therebetween. With tips 28 and 26 held together, collar 30 is pulled inside out by sliding it over head portion 22 and onto head portion 24, as shown in FIG. 4. In this manner, the collar point has been turned, so as to hide the seams 32.

What is claimed is:

1. A device for turning collar points and tubular parts of garments comprising first and second members crossing each other and being pivotally attached at a point in scissors fashion, each said member including a handle portion and a head portion on opposite sides of the pivot point, the head portions each terminating in end portions moveable from abutting to non-abutting relationship by a scissors movement of the first and second members, the end portion of the first member tapering to a fine tip having a first contact area, the end portion of the second member defining a second contact area, wherein the second contact area is greater than the first contact area, whereby the tips cannot become misaligned under normal working conditions.

2. The device of claim 1 wherein the head portions of the first and second members, excluding the respective end portions, are elongated and symmetric, and when said end portions are in abutting relationship define a generally oval-shaped garment turning member.

3. The device of claim 1 wherein the head portions of the first and second members are each of uniform cross-section along their lengths, excluding their respective end portions.

4. A device for turning collar points comprising first and second arms which cannot become misaligned during use, said arms crossing each other in scissors fashion at a point and being pivotally attached at the point where they cross, said arms terminating in opposed, abutting tip portions, one of said tips defining a larger contact area than the contact area defined by the other of said tips; said abutting tips being separable by a scissors-like movement of the arms.

* * * * *